US007997785B2

(12) United States Patent
Chien

(10) Patent No.: US 7,997,785 B2
(45) Date of Patent: Aug. 16, 2011

(54) LINEAR TUBE NIGHT LIGHT WITH CHANGEABLE LIGHT PATTERNS

(76) Inventor: Tseng-Lu Chien, Taipei Hseng (TW)

( * ) Notice: Subject to any disclaimer, the term of this patent is extended or adjusted under 35 U.S.C. 154(b) by 0 days.

(21) Appl. No.: 11/092,742

(22) Filed: Mar. 30, 2005

(65) Prior Publication Data

US 2006/0227574 A1 Oct. 12, 2006

(51) Int. Cl.
*H01R 33/00* (2006.01)

(52) U.S. Cl. ..... 362/641; 362/640; 362/644

(58) Field of Classification Search ..... 362/640–644, 362/551–582, 217.01–217.17, 218–225, 362/362–378
See application file for complete search history.

(56) References Cited

U.S. PATENT DOCUMENTS 6,171,117 B1 * 1/2001 Chien ..... 362/84
6,390,647 B1 * 5/2002 Shaefer ..... 362/276
6,759,814 B2 * 7/2004 Vogel et al. ..... 362/545
6,926,426 B2 * 8/2005 Currie et al. ..... 362/282
2006/0007709 A1 * 1/2006 Yuen ..... 362/641
2006/0062019 A1 * 3/2006 Young ..... 362/641

* cited by examiner

*Primary Examiner* — Diane I Lee
*Assistant Examiner* — William J Carter
(74) *Attorney, Agent, or Firm* — Bacon & Thomas, PLLC

(57) ABSTRACT

A linear tube night light with changeable light patterns includes a light source selected from the group consisting of at leas one LED, strobe light, neon light, gradation light, black light, LED inside tube, high voltage discharge light, arc light, fluorescent light, EL wire, EL twisted light, EL panel light, and/or EL strips, with changeable light patterns being effected by automatic or manual control means to obtain light patterns such as chasing, random, fade in and fade out, pair flashing, scan, flashing, steady on, gradation neon effects, lighted length changing, color changing, sequential flashing, and any other combinations of conventional market available functions. The linear tube night light with changeable patterns further may incorporate a light sensor, sound sensor, or timer to get the predetermined light effects and duration.

4 Claims, 5 Drawing Sheets

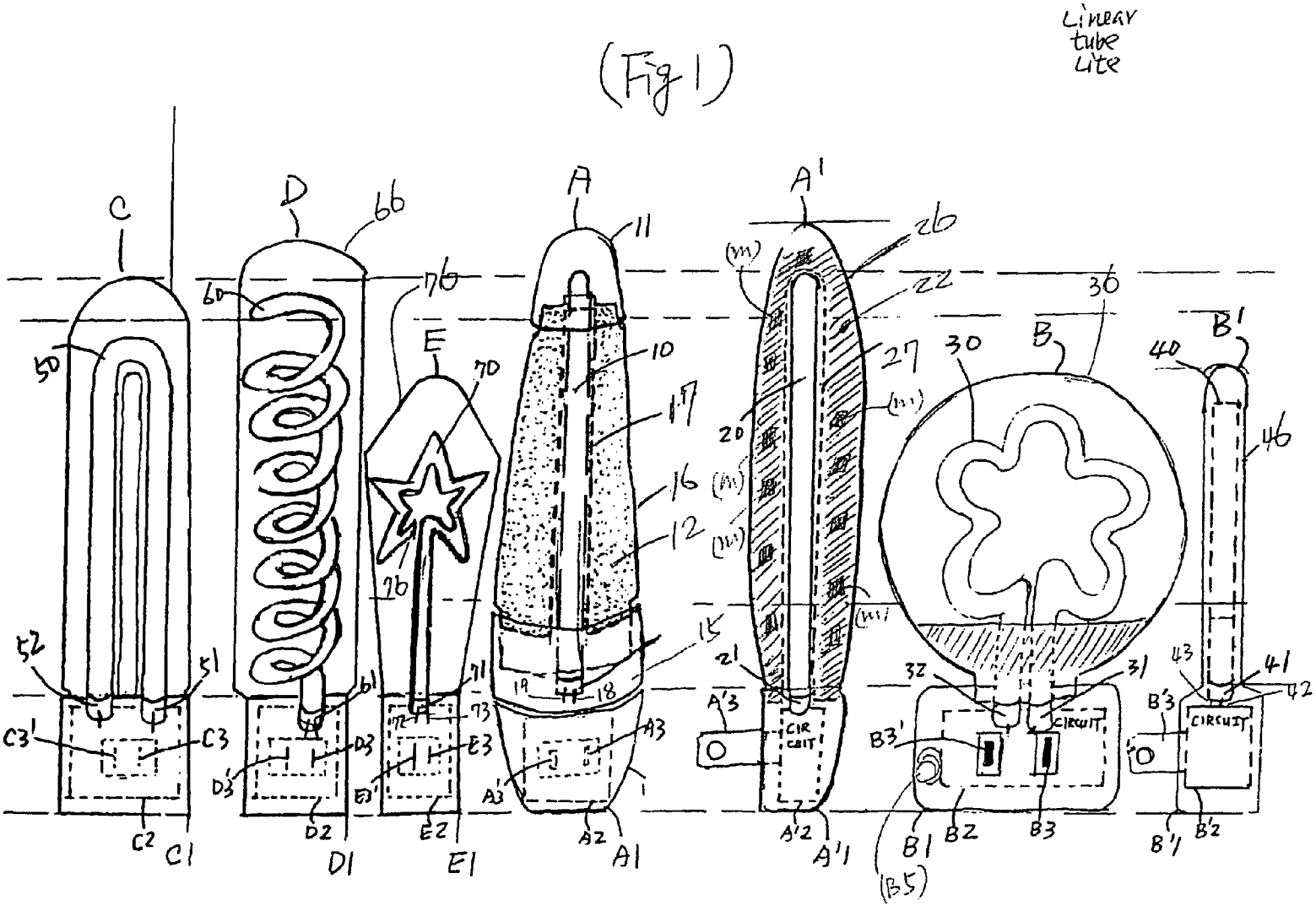
(Fig 1)

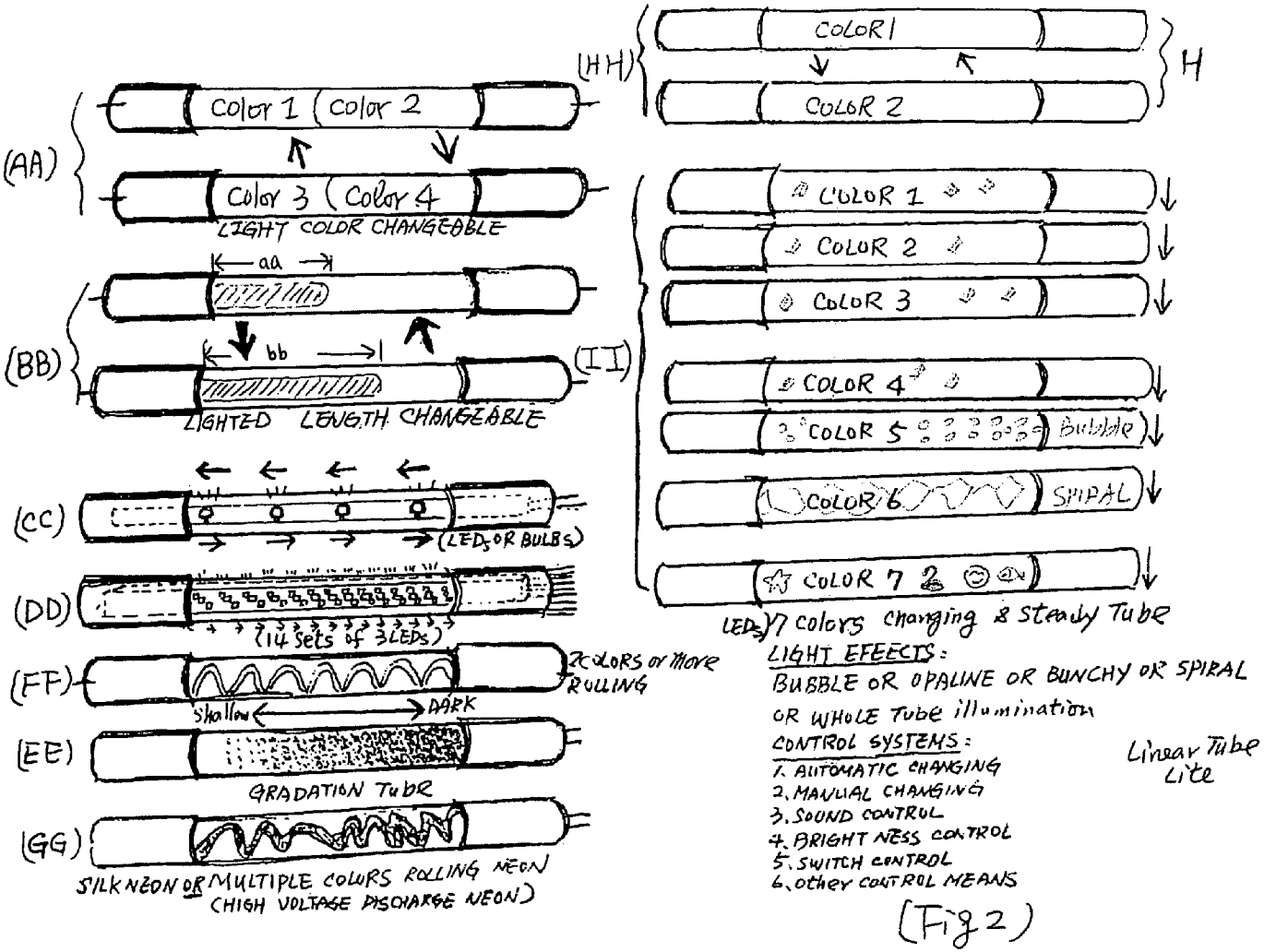
(Fig 2)

(Fig 3)
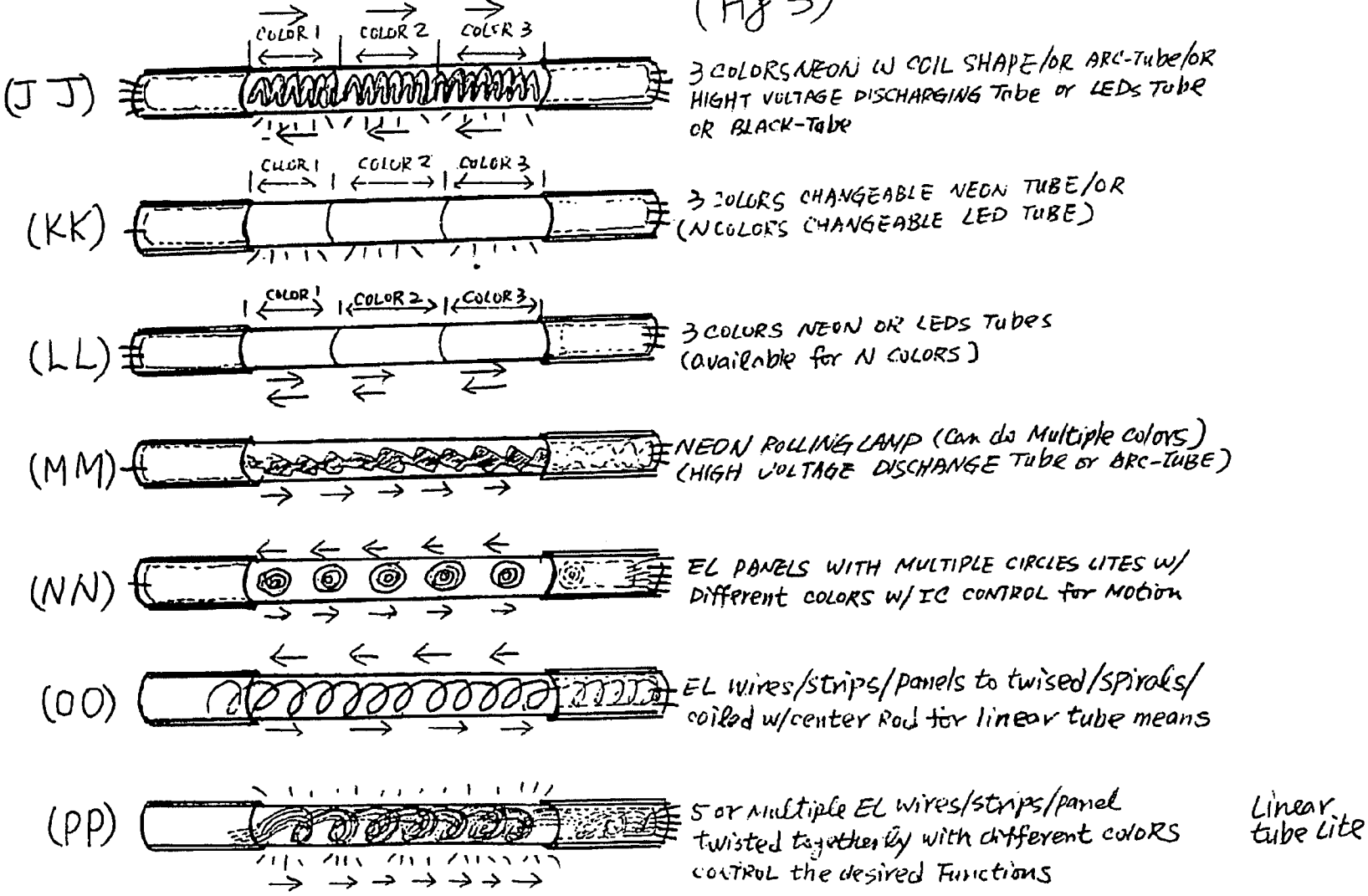

(Fig 4)
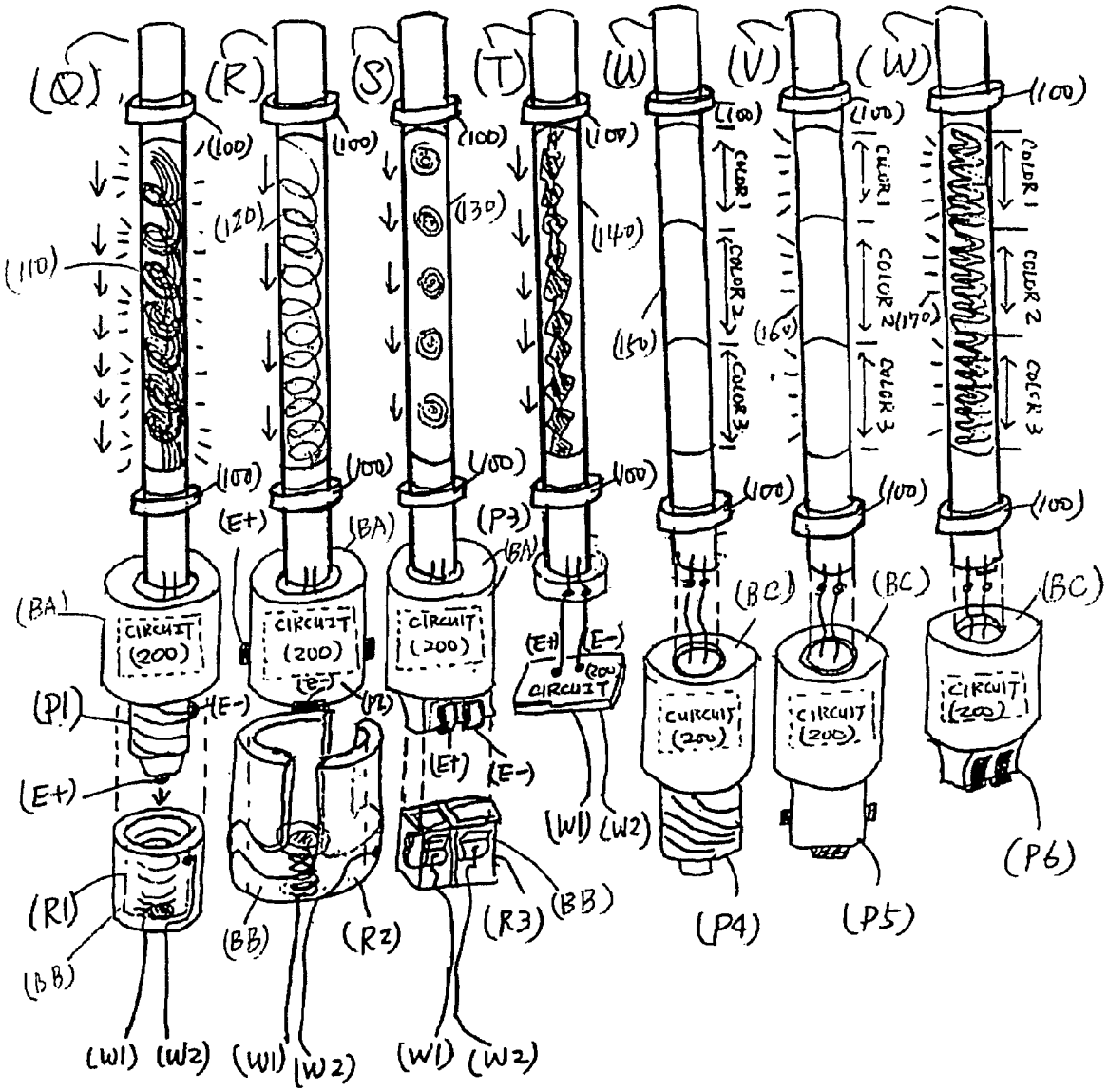
Linear tube Lite (Fig 5)
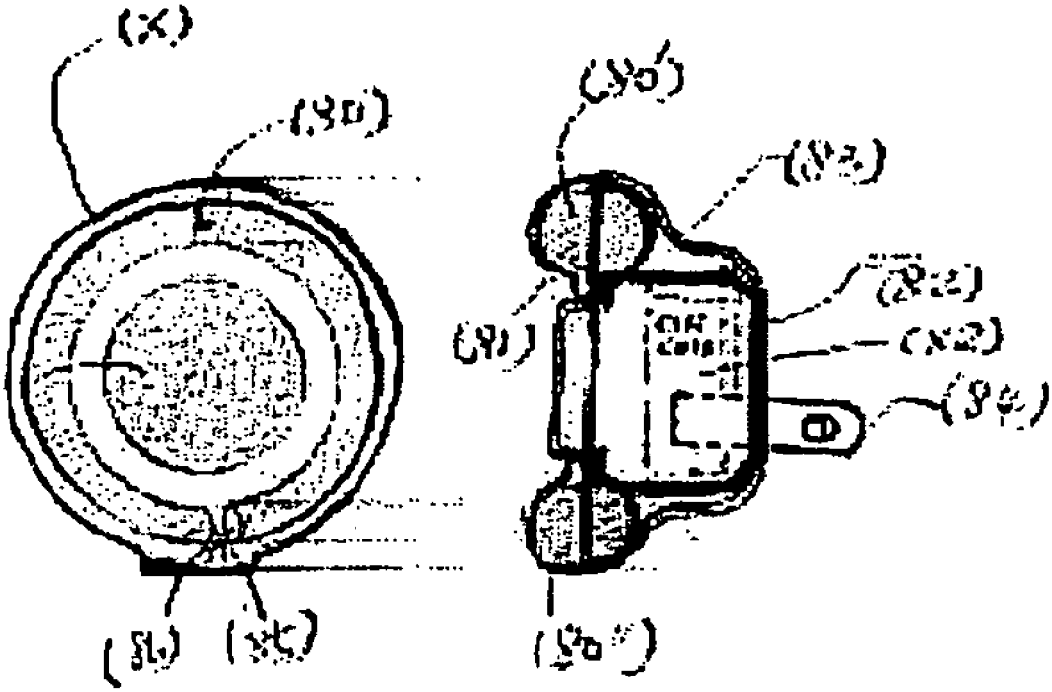

LINEAR TUBE NIGHT LIGHT WITH CHANGEABLE LIGHT PATTERNS

This application is related to Ser. Nos. 10/883,747 and 10/954,189 and 10/667,787 and 10/286,871.

BACKGROUND

The Inventor's prior art U.S. Pat. Nos. 5,926,440, 6,158,868, 6,170,958, 6,171,117, and 6,280,053 disclose arrangements for the conductive means of night lights including a multiple function night light incorporated with a time piece. Other patents include U.S. Pat. Nos. 4,947,291, 5,495,402, 5,662,408, 5,713,655, 5,803,579, 5,816,682, 5,833,350, 5,893,626, 5,998,928, 6,000,807, 6,010,228, 6,031,958, 6,033,087, 6,056,420, 6,132,072, 6,160,948, 6,161,910, 6,183,101, 6,190,017, 6,290,368, 6,337,946, 6,386,730, 6,390,647, 600,104, 6,411,524, 6,431,719, 6,509,832, 6,523,976, 6,550,949, 6,609,812, 6,623,416, 6,641,289, 6,648,496, 6,709,126 show different light sources and applications, but none of these applications and patents teach a night light incorporated with a linear light means with a linear light pattern. The current invention is a brand new and exciting accent light which not only offers basic night light illumination but also offers changeable light patterns to make the illumination less boring and convert the night light into an imagination light device that encourages people to dream and contemplate advice while looking at the changeable light patterns night light.

The linear tube of the invention has a linear configuration that can be formed into a straight, curved, shaped, and/or geometric design with light beams being emitted out along its elongated length to the viewer. The linear tube means may selected from the group consisting of:

(L1) a neon tube,
(L2) a black tube,
(L3) EL wires inside a tube, EL strips inside a tube (as in co-pending U.S. patent application Ser. No. 10/286,871), or twisted EL elements inside a tube,
(L4) LEDs inside a tube,
(L5) a gradation light inside a tube,
(L6) a high voltage discharge tube or arc light tube,
(L7) a fluorescent tube, and
(L8) gas filled bulbs inside a tube, The linear tube night light with changeable light patterns of the current invention can emit visible wavelengths that change when a circuit means offers different electric signals to the light means. The changeable patterns may be selected from the group consisting of (f1) chasing, (f2) random, (f3) fade in and fade out, (f4) pair flashing, (f5) scan, (f5) flashing, (f7) steady on, (f8) gradation neon effects, (f9) lighted length changing, (f10) color changing, (f11) sequential flashing, or (f12) any other combinations of conventional commercially-available functions.

The linear tube night light with changeable patterns of the current invention further may incorporate (d1) a sensor device, (d2) a timer device, (d3) a control device, or (d4) a rotating device to enable the circuit means to offer the desired electric signals to turn the linear tube means for a desired light show, functions, and effects, for a predetermined time period or duration.

The linear tube night light with changeable patterns of the current invention may further incorporate medium means which may be selected from the group consisting of (m1) oil, (m2) a solid plastic body, (m3) a light transmitting material, or (m4) any medium means which can cause the light to have reflective, diffusion, or other optics properties and that can be incorporated into the linear tube to increase the value, appearance, and/or accent of the night light.

The changeable light patterns will create a night light's light beam with changing visible wavelengths to be seen by the viewer, resulting in a splendid light appearance and delicate light applications for building, house, residence place, dark environment, and commercial areas for all outlet receptacles in those areas.

DRAWINGS

FIGS. 1A to 1D show a variety of embodiments with different configurations of night light and linear tube.

FIG. 2 shows a variety of embodiments for a linear tube night light with changeable light pattern of the current invention, the linear tube having different changeable patterns as shown in sub-parts (AA), (BB), (CC), (DD), (EE), (FF), (GG), (HH), and (II).

FIG. 3 shows a variety of embodiments of a linear tube night light with changeable light patterns and functions illustrated in sub-parts (JJ), (KK), (LL), (MM), (NN), (OO), and (PP).

FIG. 4 shows a variety of embodiments of a linear tube night light with changeable light patterns, the tubes illustrated in sub-parts (Q), (R), (S), (T), (U), (V), and (W) having different constructions and electric connections.

FIG. 5 shows a preferred embodiment (X) with a desired linear tube, housing, and rotating prong means to let people see a whole circular neon linear tube from a front view and a side view.

DETAILED DESCRIPTION OF THE PREFERRED EMBODIMENTS

FIG. 1 shows a variety of embodiments of a linear tube night light with changeable patterns (A) (A') (B) (B') (C) (D) (E). The embodiment (A) has a Base (A1) on which is installed circuit means (A2) and prong means (A3) (A3') so that the prong means can be connected with a power source to supply electricity to circuit means (A2) to turn on the linear tube (10), which causes illumination to pass though the medium means (12) to generate light beams with desired reflective and wave patterns even without changing the circuit output. The medium means may be selected from group consisting of (m1) water, (m2) a chemical, (m3) oil with different densities and color, (m4) a reflective piece, (m5) and a solid medium material to provide the linear tube light beams with optics properties such as reflective or diffusion effects. The preferred medium means (12) are sealed within a fully transparent housing (16) with a center channel (17) to allow the linear tube (10) to be installed within a shock and vibration protection device (not shown). The medium housing (16) is attached on the top housing (11 and lower housing (15) to cover the two ends of the linear tube and provide a nice appearance. The base (A2) is fixed the lower housing (15). The electrode(s) or terminal(s) of the linear tube are connected with circuit means (A2) by conventional skill or method with circuit means (A2) arranged to supply the electric signals to turn on linear tube as expected. The electrodes (18) (19) of the linear tube (10) are on one end because the whole medium means housing (16) is transparent and therefore use of electrodes on two ends, while possible, may result in a less attractive appearance.

Embodiment (A') has an alternative construction. The medium media (22) are sealed inside housing (26) with very nice optics properties resulting from a certain number of miniature means (m) situated within the medium media (22), which may include any material such as a shell, leaves, a dry flower, potpourri, a cut flower, a plastic piece, floating stuff, a fish, a smiling face, a metal piece, a paper piece, a wood piece, or any material with designed shape and colors that is available to put inside the medium means to increase the value, and improve the appearance to let the medium means (26) look like conventional gift items. The included materials may be arranged into a scene inside the housing (26, to form a seasonal water ball, artificial aquarium, or kids toy with sealed liquid applications. The medium media (26) have a center channel to allow installation of a linear tube having a diameter from 2 mm to 30 mm with a preferred length from 0.5 inch to 60 inches. The base (A'1) offers a space to install the prong means (A'3) and circuit means (A2') with proper connection means to enable electric signal delivery from the power source to the linear tube light means.

Embodiment (B) includes a round housing (36) in which is installed a shaped linear tube (30) with two electrodes (31) (32) on each end and connected with circuit means (82) by conventional available skill or method to obtain electric signals from the circuit means to cause the light means have desired functions and effects. The prong means (B3) (B3') and circuit means (B2) are installed inside the base (B1). A manual control means (B5) is arranged on the base (B1) to allow people to change the night light from the first light function change to another function by manual control means and get visible light with different functions selected from the group consisting of (f1) chasing, (f2) random, (f3) fade in and fade out, (f4) pair flashing, (f5) scan, (f6) flashing, (f7) steady on, (f8) gradation neon effects, (f9) lighted length changing, (f10) color changing, (f11) sequential flashing, and (f12) any other combinations of conventionally available functions. The control means (B5) offer the electric signals to circuit means to drive the linear tube to change function. The linear tube (30) means may selected from the group consisting of (L1) a neon tube, (L2) a black tube, (L3) EL wires inside a tube, EL strips inside a tube (as co-pending Ser. No. 10/286,871), or twisted EL elements inside tube, (L4) LEDs inside a tube, (L5) gradation light inside a tube, (L6) a high voltage discharge tube or arc light tube, (L7) a fluorescent tube, (L8) gas filled bulbs inside a tube, and (L9) a cold cathode tube.

The night light (B) has an appropriate electric connection of the linear tube (30), circuit means (B2), control means (35), prong means (B3) (B3') to enable delivery of electricity from prong means (B3) (B3') to the light means (30) to get desired light effects and functions for a predetermined time, period, or duration.

Embodiment (B1') includes a linear tube (40) sealed within a geometric shape of housing (46) with electrodes (42) (43) connected with circuit means (B'2) and prong means (B'3). The base (B'1) is attached to housing (46) and prong means (B'3) to make a linear tube night light with changeable light patterns having automatic control means inside the circuit means to cause the light pattern to change according to requirements. The automatic control means can easily be provided in the form of an integrated circuit (hereafter as IC) which can be obtained from conventional market available models.

From embodiment (D), the linear tube (60) is in a spiral, twisted, coiled, or cylinder shape to provide a nice and valuable appearance. The light function with patterns changeable for multiple colors such as three colors on the top, middle, and lower portion of the linear tube. The linear tube also can have a motion function such that the light will move from the top to the end with back and forth cycles similar to scan functions. The linear tube may use a neon tube, high voltage discharge tube, or multiple LEDs on a flexible printing circuit board (hereafter as PCB) so that the scan functions can provide a motion light with a continuously changeable pattern while the power source is connected with the prong means (D3) (D'3). The circuit means (D2) has a built in IC to cause the pattern to change automatically without any manual switch needed. The housing (66) is sealed in the linear tube (60) and attached to the base (D1) to enable the linear tube night light with changeable patterns to form convenient units.

In embodiment (D), the linear tube (70) has a star shape. One end (76) is visible from the housing (76). The other end (71) has two electrodes (72) (73) to connect with the circuit means (E2), and the circuit means (E2) connects with prong means (E3) (E3') to a power source. The circuit means has a built-in IC to provide the star with a variety of patterns that change automatically and which may selected by changing length while using a neon tube with its circuit, or by changing electrical current while using a high voltage discharge tube. This embodiment can also use LEDs on a flexible PCB to fit into a flexible and bendable tube to get sequential, random, pair flashing, scan, fade in and fade out, steady on, all flashing, all steady on or other light functions as desired.

Embodiment (C) includes a the linear tube (50) arranged in a reverse U-shape and two electrodes (51) (52) that are connected with the circuit board (C2) and installed on base (C1). The prong means (C3) (C'3) are connect with wall outlet receptacles or extension cord receptacles to get power to drive the linear tube with desired functions and effects.

FIG. 2 illustrates embodiments with different patterns (AA) (BB) (CC) (DD) (EE) (FF) (GG) (HH) (II). In embodiment (AA), the tube can have multiple colors such as color 1 and color 2 and can change the pattern to color 3 and color 4. The tube can be a neon tube or LEDs inside a tube. While using the neon tube, the color change can be made simple to enable the circuit means with different outputs to cause the neon tube to change colors from the original colors. While use LEDs inside the tube, the most simple is to use Red and Green and Blue (hereafter as RGB) LEDs to provide a proper steady on and timing control to mix the colors to get the color change. It is also possible to use specially made LEDs to obtain this color change.

In embodiment (BB), the tube can have the lighted length change from short (aa) to longer length (bb) or any length by automatically changing the light pattern or controlling the pattern by means of a sound sensor or the like. The tube may be selected the neon light or LEDs inside a tube. Changing the electric, signals output from the circuit means can easily cause the lighted length to change according to desired patterns.

In embodiment (CC), a tube with multiple LEDs, gas filled bulbs, neon bulbs or other spot light sources are situated inside a rigid or flexible tube means. Proper circuit means with an IC can be used to provide a variety of spot light means to cause fade in and fade out, sequential, flashing, random, chasing, pair flashing, scan, steady on or any combination of these functions with desired on-time, duration, period, cycles to create incredible and eye-catching effects.

In embodiment (DD), the tube has a plurality of areas with ROB LED arrangements. The on-time, sequence, time, period, and cycles of the LEDs are controlled by an IC to create the desired colors, functions, and effects. The LEDs can use chips, dice, and sealed units in a variety of shapes to make the desired dimension fit into rigid or flexible tube means for proper application of the night light. The seated RGB unit can be have one single shaped LED with changeable color instead of the three piece shaped LED units to get the same function. It may be advantageous to fit the single shape LED into a tiny space of a C-7 bulb shape to fit into a C-7 base for a light source.

In embodiment (EE) gradation tube means with flexible and bendable tube means arc provided. The gradation light can be made from LED, EL, OEL, OLED, and conventional neon lamps with a gradation phosphor arrangement, or as the result of a front surface filter treatment to get gradation effects corresponding to the effects provided by a conventional market available gradation light tube.

Embodiment (FF) includes silk-screened lighted areas while embodiment (GG) includes multiple color lighted areas with rolling light effects. The tube can have the feature that when a hand is placed on the multiple color linear tube, a stream of electricity will change the light patterns with exciting light effects. The electricity streams are moving at all the time while the prong means are connected with a power source and circuit means to offer the electric signal to the linear tube (GG).

Embodiment (HH) exhibits a color change from color 1 to color 2 and then back from color 2 to color 1. This kind of color change can use conventional LED, EL, OEL, OLED, and neon lamps or lighting elements, and/or a high voltage discharge tube, EL wires, EL twisted panels, and EL coiled strips as light means to get such effects automatically or via manual control means.

Embodiment (II) exhibits a color change from color 1→2→3→4→5→6→7, which color changing can be provided by a light source selected from LED, EL, OEL, or OLED lighting elements with proper circuit and light means. The LEDs can be arranged on the end of the tube means to make the cost lower. The tube means can be made of a rigid or soft material with solid material within. A preferred application is to use the solid material with treatment along the elongate length with bubble, opaque, bunchy, or spiral arrangement within the tube to make the light beams have other dedicated designs for illumination. It also can use a medium with miniature materials (such as fish, smile face, star, swan, metal piece, paper piece, plastic piece) to get desired optics properties as described above.

FIG. 3 shows a plurality of linear tube arrangements. Embodiments (JJ) (KK) (LL) show the three colors in coil shape of a linear tube. The light means can be selected from neon, a high voltage discharge tube, a gradation tube, LEDs inside the tube, or a gas filled bulb inside a tube. The proper circuit means will drive the three color tube for desired functions which can have any combination of earlier discussed function (f1) to (F12) for 12×12 assorted light functions with automatic or manual control means.

Embodiment (MM) is a rolling motion light which can be a neon or high voltage discharge tube and which has an electricity stream moving within the tube all the time while the power source is connected to the circuit means to drive the linear tube with this rolling function. It also can have other active motion effects. For example, when a hand touches the light means, the stronger electricity streams will become stronger. This is a very good pattern changing application.

Embodiment (NN) is an HL, OEL, OLED application in which the phosphor areas have different colors and a selected shape and size so as to provide shaped lighted areas with desired color. Proper circuit means can be used to drive the shaped lighted areas to turn on and exhibit desired functions such as functions (f1) to (f12) described above. Similarly, embodiment (OO) can use EL, OEL, or OLED strips, wires, panel to be twisted, coiled, spirals with a center rod or metal piece to make a tube design as described in co-pending U.S. patent application Ser. Nos. 10/286,871 and 10/107,584 and 10/341,519 and at least one prior issued patent.

Embodiment (PP) uses multiple EL wires twisted together to make a linear tube with desired light function. Each of the EL wires forms an individual light means under IC control to get splendid light effects and functions. The functions can be selected from the above-described functions (f1) to (f12) or any combination of these 12×12 assorted light functions.

FIG. 5 shows a round neon tube night light with changeable light patterns. The night light (X) has a linear tube (80) with two electrodes (85)(86) connected with the circuit means (X2) by conventional skills. From the side view, the linear tube (80') (80") forms a circle and is installed on the front housing (81), back housing (82), and outer case (83). The back housing with prong means (84) and circuit means (x2) is installed and sealed with front housing (81) to allow the prong means to be rotated to any orientation. The conventional linear tube means has the diameter of a neon tube, which is typically from 2 mm to 15 mm, though the diameter may be varied depending on market requirements. For a strobe tube a common diameter is around 4 mm but this may be varied according to customer design. An LED light within the tube can have any size because an LED has dice, chip, or sealed unit for very tiny dimension. A black tube, gradation tube, discharge tube, cold cathode tube, and EL, OEL, OLED lamps or lighting elements can also have any customer design without any difficulty.

FIG. 4 shows a variety of arrangements for linear tube connection and installation.

Embodiment (Q) includes a light means (110) installed on a base (BA), the base including a prong base (1) with contact means (E+) (E−) to insert into the receive base (R1) of the receptacle base (BB). The circuit means (200) are inside the base (BA) and electrically connected with the linear tube (110). The base (BA) is a screw type base or other bulb base. The embodiment (R) is similar to the conventional market bayonet bulb base. The embodiment (S) is similar to the conventional wedge bulb base. The embodiment (T) does not use any base, prong base, or receptacle base but only a circuit means (200) connected with linear tube (140) and output wires (W1) (W2) to connect with desired power source. The linear tube's electrodes (140), circuit (200), and wires (W1) (W2) are well inside a housing (not shown) to make a safety application of the night light. Embodiments (U) (V) (W) show a linear tube (150) (160) (170) that uses wires and a soldering method to connect with base (BC) at a spaced distance to obtained the desired arrangement. As shown in FIG. 4, the installation for the linear tube with the circuit means and base means can have a variety arrangements and designs depending on market requirements and space considerations. The above discussed embodiments should not limit the spirit of the current invention for a linear tube night light with changeable light patterns. It is to be appreciated that the invention is intended to include all alternative methods, functions, treatments, arrangements, and so forth, and may further incorporate additional functions.

The invention claimed is:

1. A linear tube night light with multiple functions, comprising:

at least one prong means for supplying electricity to a circuit means when the prong means are connected with a power source;

at least one linear light tube containing a light source, said light source being distributed along a length of the linear light tube and arranged to emit light upon being supplied with electricity, said linear light tube selected from a group consisting of a neon tube; a black light tube; a gas filled tube; a gradation light inside a tube; a high voltage or arc light tube; and multiple LEDs inside a tube, said circuit means being for supplying electricity from said prong means to said light source withing the linear light tube;

at least one transparent housing enclosing the linear light tube and not the circuit means, said transparent housing enclosing said linear light tube to prevent a user from touching the linear light tube and the light source within the linear light tube, and to protect the linear light tube from damage, wherein the linear light tube and light source are not replaceable within the transparent housing by the user; and at least one non-transparent or translucent housing enclosing the circuit means and not the linear light tube and light source, said non-transparent or translucent housing further enclosing a control means, the prong means, terminals of the linear light tube and light source, and connecting means for connecting the control means, prong means, terminals, and connecting means, wherein the control means is arranged to cause the linear light tube and light source, to exhibit a light performance selected from a group consisting of changing functions, colors, light patterns, image size, lighted area dimension, other light image physical properties, and combinations of different lighting effects, wherein said linear light tube has a visible length of between 0.2 and 60 inches measured from end to end, wherein said linear light tube has a diameter of between 2 mm and 30 mm, and wherein said linear light tube is incorporated with an integrated circuit that provides said linear light tube with lighting effects selected from changeable light patterns, changeable brightness, and changeable colors.

2. The linear tube night light of claim 1, wherein the control means includes a switch device, sensor device, and integrated circuit for enabling said performance to vary based on input from said switch device or said sensor device.

3. The linear tube night light of claim 1, wherein said housing further includes a medium selected from the group consisting of water, chemicals, oil with different densities and color, reflective pieces, and a solid medium material to cause the housing to have further optical properties.

4. The linear tube night light of claim 1, wherein said linear tube is bent to form a geometric shape.

* * * * *